US005564348A

United States Patent [19]

Gröschl et al.

[11] Patent Number: 5,564,348

[45] Date of Patent: Oct. 15, 1996

[54] PROCESS AND A DEVICE FOR REGULATING THE COMBUSTION OF SOLID FUELS IN A COMBUSTION PLANT

[76] Inventors: Rupert Gröschl; Johann Gröschl; Josef Gröschl, all of A-8781, Wald/Schoberpass; Rudolf Pressl, Puchen 211, A-8992 Altaussee; Peter Tomaschitz, Grabenstr. 45, A-8020 Graz, all of Austria

[21] Appl. No.: 162,051

[22] PCT Filed: Apr. 6, 1993

[86] PCT No.: PCT/EP93/00853

§ 371 Date: May 2, 1994

§ 102(e) Date: May 2, 1994

[87] PCT Pub. No.: WO93/21476

PCT Pub. Date: Oct. 28, 1993

[30] Foreign Application Priority Data

Apr. 8, 1992 [DE] Germany ..... 42 11 839.5

[51] Int. Cl.[6] ..... B09B 3/00; F23D 14/00

[52] U.S. Cl. ..... 110/235; 110/248; 122/2

[58] Field of Search ..... 110/235, 242, 110/248, 256; 122/2

[56] References Cited

U.S. PATENT DOCUMENTS

| | | | |
|---|---|---|---|
| 1,769,880 | 7/1930 | Howle | 110/248 |
| 2,608,943 | 9/1952 | Weggel | 110/235 |
| 2,829,610 | 4/1958 | Paskowski | 110/248 |
| 3,043,246 | 7/1962 | Hebert | 110/248 |
| 4,080,909 | 3/1978 | Nalbandian et al. | 110/235 |
| 4,976,209 | 12/1990 | Piggin | 110/235 |

FOREIGN PATENT DOCUMENTS

| | | |
|---|---|---|
| 537255 | 3/1959 | Belgium . |
| 1136045 | 9/1962 | Germany . |
| 2648732 | 6/1977 | Germany . |
| 2927152 | 1/1981 | Germany . |
| 22611 | 9/1915 | United Kingdom . |

*Primary Examiner*—Thomas N. Moulis

*Attorney, Agent, or Firm*—Jacobson, Price, Holman & Stern, PLLC

[57] ABSTRACT

A process for regulating the combustion of solid fuels in a combustion plant is characterized in that the incompletely burned gases that are formed directly above the area of the combustion outlet are directed upward along the inner wall of the charge space, which runs between the charge space and the combustion chamber, and along the cover area of the charge space into the channels between the charge space outer wall and the furnace wall, as a down-draft, back to the fire bed. In a device for carrying out the process above the combustion outlet there is a cover that shields the opening of the combustion outlet against the passage of incompletely burned gases that form above the combustion outlet and/or within the cover area of the charge space there is a channel that connects the upper area of the charge space with the channel(s) that run between the charge space and the furnace wall and which introduces the incompletely burned gases that form above the combustion outlet into the down-draft of the mixture of air and incompletely burned gases in the channel(s), when if necessary the charge space cover channel provided in the cover area of the charge space is connected to a fresh air feed and/or if necessary the channel(s) between the charge space and the furnace wall is connected to a fresh air feed.

20 Claims, 2 Drawing Sheets

Figure 1:
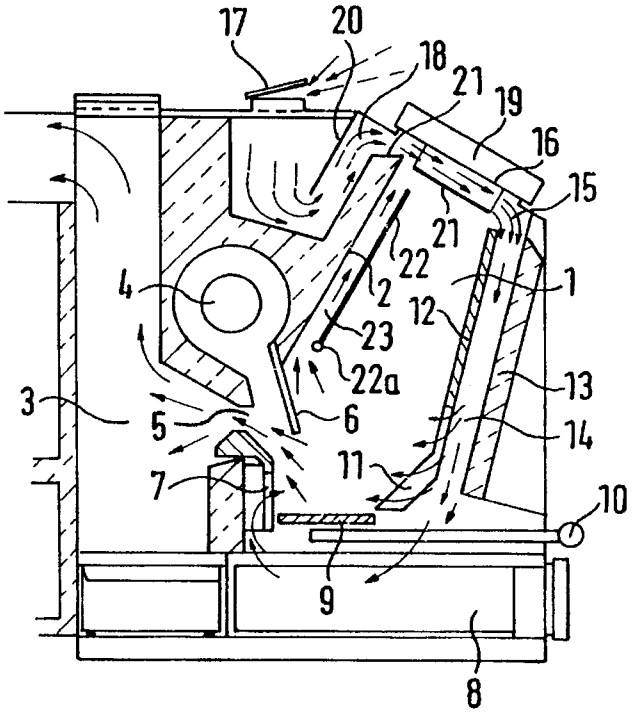

PROCESS AND A DEVICE FOR REGULATING THE COMBUSTION OF SOLID FUELS IN A COMBUSTION PLANT

The present invention relates to a process for regulating the combustion of solid fuels in a solid fuel combustion plant, in which the incompletely burned gases that are formed in the loading chamber are returned as a down-draft flow through at least one channel that is provided between an outer wall of the loading chamber and a wall of the furnace, in the lower area of the loading chamber, and into the fire bed of the loading chamber.

In the combustion plant described in DE-PS 26 48 732, the loading shaft is separated from a combustion chamber that follows the loading shaft by a wall; the combustion chamber is connected to the loading shaft through a passage opening, the so-called combustion outlet. In addition, at least one channel runs between the wall of the furnace and the loading shaft and the lower end of this is connected through a port with the lower area of the loading shaft and the upper end is connected through a further passage opening to the upper area of the loading shaft. A mixture of incompletely burned gas and air is passed to the channels through the upper port and this flows downwards as a down-draft in the channel(s), and is delivered for combustion through the lower port to the incandescent bed that is located in the area of the grate.

However, the combustion process in this known filling shaft combustion furnace is still not satisfactory, for the cooler incompletely burned gases that form in the area of the combustion outlet influence combustion in a disadvantageous manner. The cooler incompletely burned gases flow, in part, directly through the combustion outlet and into the combustion chamber. As a result of this, complete combustion of these incompletely burned gases becomes impossible. In addition, on the opposite side of the combustion outlet, the combustion material burns very intensely. In order to eliminate the negative effects on combustion that result from this, and in order to arrive at satisfactory combustion of the combustion materials, up to now it has been necessary to intensify the air-gas mixture ahead of the combustion outlet, which once again leads to more rapid combustion in this area, and this results in a so-called empty burn in this area; this means that the air-gas mixture that is delivered moves directly into the flow of exhaust gas, without passing through the fire bed.

It is the task of the present invention to identify measures that ensure that the incompletely burned gases that form in the vicinity of the combustion outlet, and which arrive there, no longer flow downwards, through the combustion outlet.

In the process according to the present invention, the incompletely burned gases that are formed immediately above the area of the combustion outlet are directed upwards along the inner wall of the loading chamber that runs between the loading chamber and the combustion chamber, are returned along the cover area of the loading chamber in the channels between the outer wall of the loading chamber and the furnace wall, and back to the fire bed, as a down-draft. When this is done, it is preferred that the flow path of the incompletely burned gases be effected by supplying fresh air with an injector effect within the cover area of the loading chamber and/or by the down-draft flow of the incompletely burned gases in the channel(s) that guides the incompletely burned gas downflow, optionally with an additional fresh air feed with an injector effect.

A device that is suitable for carrying out the process according to the present invention is characterized in that a covering that screens the opening of the combustion outlet against the passage of incompletely burned gases that form above the combustion outlet be arranged above the combustion outlet; and/or that a channel (referred to hereinafter as the loading chamber cover channel) be located in the cover area of the loading chamber and connects the upper area of the loading chamber with the channels or channel that runs between the loading chamber and the furnace wall and introduces the incompletely burned gases that form immediately above the combustion outlet into the down-draft flow of the mixture of incompletely burned gas and air into the channel(s); if necessary, the loading chamber cover channel that is provided in the cover area of the loading chamber is connected to a fresh air feed and/or, if necessary, the channel or channels between the loading chamber and the oven wall are connected to a fresh air feed.

This means that two design features are suitable for carrying out the process; each, used in and of itself, results in a specific improvement of the former combustion process and, combined with each other, result in an optimization of the combustion process.

Using the first characteristic feature of the present invention which is a cover of the combustion outlet that is arranged above the combustion outlet, it can be ensured that the cooler incompletely burned gases that form at the combustion outlet can no longer move through the combustion outlet and into the combustion chamber and burden the outgoing air that is passed to the chimney. In addition, because of the covering over the combustion outlet, the chimney draft is delivered to the fire bed more effectively, which ensures more even combustion.

By using the second characteristic feature of the present invention, which is a channel that is provided in the cover area of the loading chamber, which connects the upper area of the loading chamber with the channel(s) that run between the loading chamber and the furnace wall, it is ensured that, because of the pressure relationships that are formed, the incompletely burned gases that are formed in the vicinity of the combustion outlet wall flow upwards within the loading chamber and through the loading chamber cover channel, and are delivered to the down-draft flow of the incompletely burned gas-air mixture that is directed downwards in the outer channel(s) and, together with these, are passed back into the fire bed for secondary combustion.

The efficiency of this second characteristic feature of the present invention, which can be used as an alternative to the covering of the combustion outlet, can be greatly improved if, either, the loading chamber cover channel is connected to a fresh air feed, or the outer channels are provided with a fresh air feed, or if both these measures are applied together. However, the process according to the present invention is improved most effectively by a combination of the two characteristic process features discussed heretofore.

According to a preferred embodiment, the covering of the combustion outlet is formed as an incandescent body. Because of this, the cooler incompletely burned gases that form at the combustion outlet are brought to a higher temperature. The combustion materials that lie on the incandescent body thus produce hot incompletely burned gases that flow upwards, and are thus directed away from the combustion outlet.

Preferably, the covering is formed from one or a plurality of solid plates. When this is done, the covering is most expediently arranged on the combustion outlet wall so as to be inclined downwards.

However, the covering can also be formed from cast or stone block.

In order to be able to better guide the hot incompletely burned gases that form above the combustion outlet, and preferably above the incandescent body, in an upward direction, according to a further preferred feature of the present invention a guide plate is provided at a distance in front of the combustion outlet wall, within the interior of the loading shaft, this preferably being formed as a drop or tipping wall. This guide plate forms a flow channel through which the hot low temperature combustion gases can be concentrated and guided upwards.

The fresh air feed within the cover area of the loading shaft chamber, which is provided in the apparatus according to the present invention, can be delivered with an injector effect in order to improve the flow velocity of the incompletely burned gases. Accordingly, the fresh air feed to the outer channels can also be introduced with an injector effect.

The pressure equalization that is always necessary in the vicinity of the charge-shaft cover can, however, be effected independently of the aforesaid fresh air feed.

Figure 2:
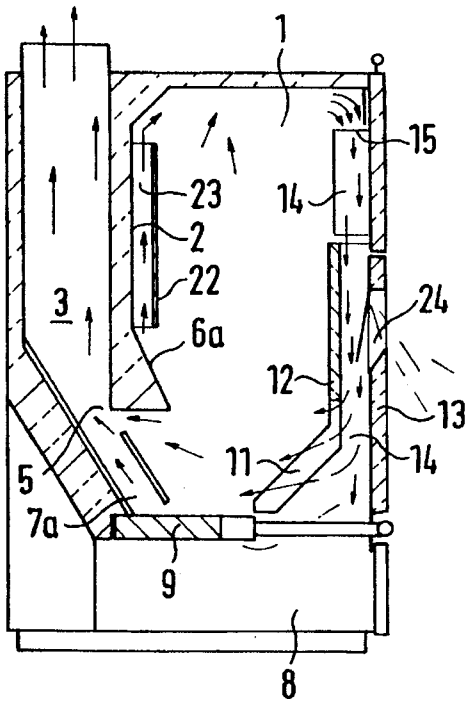
Figure 3:
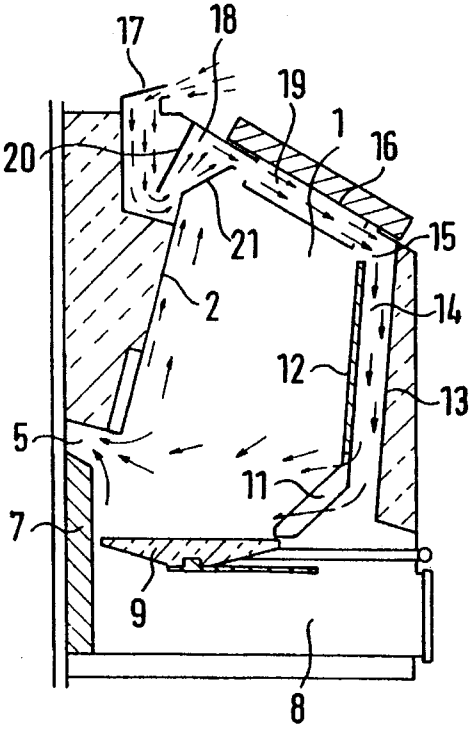
Figure 5:
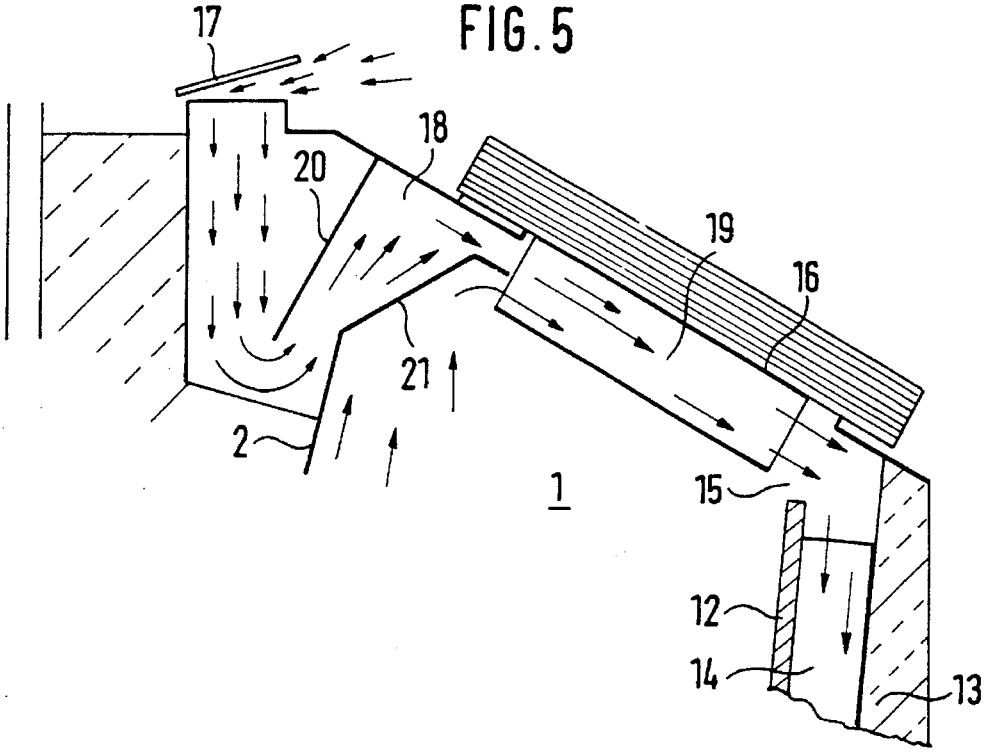
Figure 4:
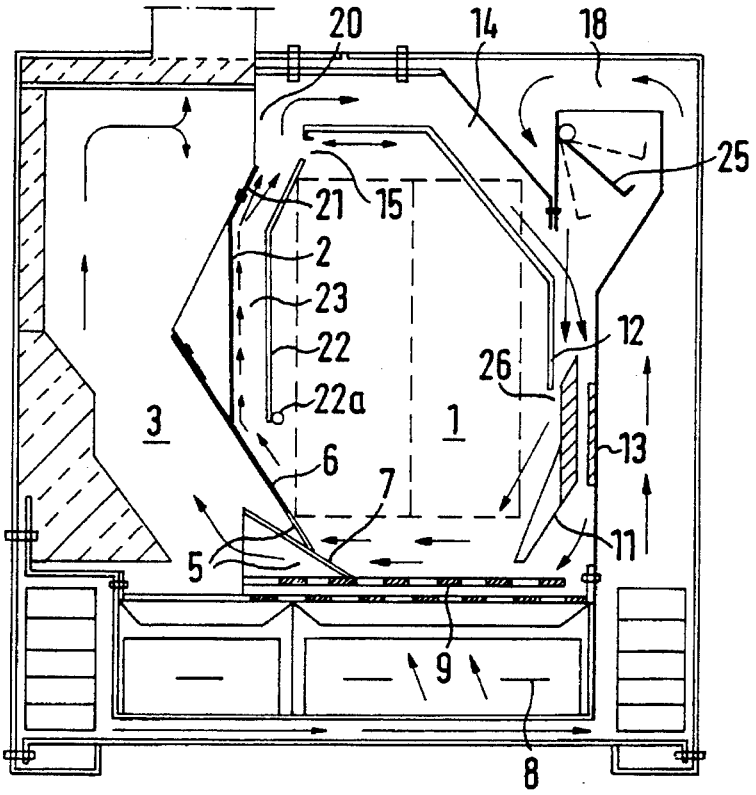

Additional preferred features of the object of the present invention are set out in the following description of embodiments that are described on the basis of the drawings appended hereto. These drawings show the following:

FIG. 1: a charge-shaft combustion furnace with multi-fuel combustion of gas or oil, shown in cross-section, which incorporates a covering of the combustion outlet and a charge-shaft cover channel with a fresh air feed incorporating injector effect, and a drop wall that runs along the wall of the combustion outlet;

FIG. 2: a room furnace [space heater ]that has no charge-shaft cover channel with a fresh air feed but in which the incompletely burned gas-air mixture is passed back through the outer channel into the fire bed with the fresh air feed;

FIG. 3: a charge-shaft combustion furnace with return of the incompletely burned gas effected in the charge-shaft cover channel, with a fresh air feed with injector effect;

FIG. 4: a self-standing space heater in which the apparatus according to the present invention, with injector effect, is incorporated;

FIG. 5: a detailed drawing from the charge-shaft cover area of the furnace shown in FIG. 1.

Within the drawings appended hereto, corresponding parts in the various figures are identified by the same reference numbers.

FIG. 1 shows a charge-shaft combustion furnace that incorporates a charge-shaft 1. The charge-shaft 1 is used to accommodate the different solid fuels such as wood, coal, coke and the like. The charge-shaft 1 is separated from a combustion chamber 3 that follows the charge-shaft 1 by means of a side wall 2. Within the side wall 2 there is an oil or gas combustion chamber 4 that opens out into the combustion outlet 5. The combustion chamber 4 serves as a combustion chamber for burning the oil or gas, when the solid fuels can be ignited at the combustion outlet 5 by means of an oil burner or a gas burner. The combustion outlet 5 is defined upwards by a covering that is configured as an incandescent body 6, and formed from one or a plurality of solid plates, by means of which the combustion outlet 5 can be covered over relative to the charge-shaft 1. The function of the incandescent body 6 is described in greater detail below.

The lower limit of the combustion chamber 5 is formed by a gas-mixing head 7 that rests against an ash grate 9 that lies above an ash pan 8. There is a channel 14 between a side wall 12 of the charge-shaft 1 and the furnace wall 13. Within the gas-mixing head 7, the air and smoke gas that is guided through the channel 14 is fed through holes and slots to the fire bed, at the combustion outlet 5 of the solid fuels. The ash grate 9 is connected to a draw bar 10 with which the fire bed can be agitated and the combustion residues moved into the ash pan 8.

At the other end of the ash grate 9 there is a so-called sliding grate 11 which continues the side wall 12 of the charge-shaft 1, which is opposite the side wall 2, in a downward direction. The lower end of the channel 14 is connected to the charge-shaft 1 through the sliding grate 11 above the ash grate 9. The channel 14 is connected at its upper end through a port 15 between the underside of the charge-shaft cover 16 and the side wall 12, the port 15 then serving as a pressure equalizing port. Then, incompletely burned gases that are formed above the fuel that is located within the charge-shaft 1 can be mixed with air in channel 14 and fed back through this into the charge-shaft 1. When this is done, the air is supplied through a fresh air shutter 17 in the vicinity of the cover of the furnace and moves in a regulated flow through a fresh air feed channel 18 and through a charge-shaft cover channel 19. FIG. 5 shows an enlarged section of the cover area of the charge-shaft 1. The fresh air flows through the fresh air shutter 17, which can be adjusted to restrict the supply of fresh air, through the fresh air feed channel 18, is directed upwards by the baffle 20, and moves towards the charge-shaft cover 16. The charge-shaft cover channel 19 that extends along the length of the charge-shaft cover 16 is located beneath the charge-shaft cover 16. Because the flow path of the fresh air that is supplied through the fresh air shutter 17 is restricted by the baffle 20 and a guide plate 21 that forms the upper end of the side wall 2 and leads towards the charge-shaft cover channel 19, the velocity of the air flow is increased and the injector effect of this picks up the incompletely burned gases that are rising through the combustion material within the charge-shaft 1, carries them through the charge-shaft cover channel 19 and guides the mixture of incompletely burned gas and air to the channel 14, in which the mixture of incompletely burned gas and air is directed downwards as a down-draft together with the incompletely burned gases that move through the pressure equalizing port 15 into the channel 14 from the charge-shaft 1 downwards and through the sliding grate 11 to the charge-shaft 1 for combustion.

The incandescent body 6 which, as discussed above, covers the combustion outlet 5, is an essential part of the charge-shaft combustion furnace shown in FIG. 1.

The incandescent body 6 is made incandescent by the hot gases that flow through the combustion outlet 5.

Because of the covering of the combustion outlet 5, the incandescent body 6 prevents the ingress of the cool incompletely burned gases that form at the combustion outlet into the combustion chamber 3. Because of the temperature of the incandescent body 6, the combustion materials that lie upon it produce hot incompletely burned gases. Thus, a preliminary zone of carbonization gases is formed above the combustion outlet 5, in which the incompletely burned gases rise along the side wall 2, which is the so-called combustion outlet wall 2, so that the return of the incompletely burned gases can be enhanced. In addition, because of the covering over the combustion outlet 5, the flue draft can be better delivered to the fire bed, with the result that even combustion can be ensured from the sliding grate 11 as far as the gas-mixing head 7 because a small residual air feed permits cleaner combustion at the gas-mixing head 7 or at the ash grate 9.

However, it should be emphasized that because of the heated and incompletely burned gases, an improved upward direction of flow and thus improved return of the incompletely burned gases through the charge-shaft cover channel 19 and the outer channel 14 is made possible.

This means that because of the aforementioned design of the charge-shaft furnace, a specific direction of flow is achieved, as a result of which the incompletely burned gas in the area of the combustion outlet is drawn upwards, essentially along the combustion outlet wall 2, and because of the injector effect and because of the effect of the down-draft in the channel 14, through the channel 14 and through the grate 11 to the fire bed within the charge shaft.

In order to effect the return of the incompletely burned gas, and in particular the incompletely burned gases that are formed in the area of the combustion outlet even more effectively along the combustion outlet wall 2 and upwards into the charge-shaft cover area, and from there through the channels 14 and back into the charge-shaft 1, a guide plate 22 is arranged on the combustion outlet wall 2, and this can pivot about the hinge 22*a*. A flow channel 23 that is directed upward is formed by the combustion outlet wall 2 and the guide wall 22, and this opens out into the charge-shaft cover area so that the incompletely burned gases that rise within it are carried along by the flow of fresh air and better directed through the charge-shaft cover channel 19 to the outer channel 14.

In other words, the incompletely burned gases are drawn off from the area above the combustion outlet 5 so that the cooler incompletely burned gases can no longer have a negative effect on the combustion process.

Because the parts of the combustion furnace that are located after the combustion outlet 5 are of no importance to the present invention, these will not be explained in greater detail.

The space heater that is shown in FIG. 2 does not incorporate the fresh air feed that is located in the cover area of the charging space 1, and which has been explained with reference to the charge-shaft combustion furnace shown in FIG. 1; neither does it incorporate the charge-shaft cover channel 19 that is connected to this. In place of the incandescent body 6 shown in FIG. 1, the combustion outlet wall 2 continues into a cast or stone block 6*a* that covers the combustion outlet 5.

The hot and incompletely burned gases rise upward through the flow channel 23 between the combustion outlet wall 2 and the guide wall 22; above the charge material they are picked up and carried downwards by the down-draft flow of the mixture of air and incompletely burned gas that comes from the charge chamber 1 and is greatly accelerated by the injector effect, within the outer channel 14, and then fed back into the fire bed.

Here, in place of the gas-mixing head 7, there is a grate 7*a* through which the required residual air can be supplied to the combustion process.

In the combustion furnace that is shown in FIG. 3, there is no air feed within the outer channel 14. In contrast to this, however, fresh air is supplied through the fresh air shutter 17 within the charge-shaft cover area, with an injector effect, and the hot but incompletely burned gas that rises along the side wall 2 is supplied along the cover area of the charge-shaft 1 to the outer channel 14, through which it is fed back to the fire bed as a down-draft.

In this embodiment, there is no covering for the combustion outlet 5. Nevertheless, because of the fresh air feed with injector effect within the cover area, it is possible to draw the incompletely burned gases upward along the side wall 2 and to feed them back to the fire bed as a down-draft.

A further embodiment of the device according to the present invention is shown in FIG. 4 in the form of a tiled stove. Once again, there is no fresh air shutter arranged in the cover area although fresh air is introduced with an injector effect through a fresh air shutter 25 at the upper end of the outer channel 14. The suction generated by the down-draft within the outer channel 14 ensures that the heated incompletely burned gases rising along the combustion outlet wall 2 are carried along and can once again be fed back to the fire bed in the down-draft flow of the mixture of air and incompletely burned gases.

In addition, on the side 12 that is opposite to and level with the combustion outlet 5, an injector effect 26 is exerted on the incompletely burned gases within the charge space 1 with the help of the sliding grate 11, with the mixture of air and incompletely burned gas in order to amplify the desired flow path.

REFERENCE NUMBERS

1 charge shaft, filling space
2 side wall combustion outlet wall
3 combustion chamber
4 oil or gas combustion chamber
5 combustion outlet
6 incandescent body, combustion outlet monitoring
7 burn-through grate, gas mixing head
8 ash pan
9 ash grate, barrier air grate
10 draw bar
11 sliding grate
12 side wall, opposite wall of combustion outlet
13 furnace wall
14 channel
15 port, pressure equalizing port
16 charge shaft cover - underside
17 fresh-air shutter
18 fresh-air feed channel
19 charge shaft cover channel
20 baffle
21 guide plate
22 guide wall
22*a* guide-wall hinge
23 flow channel
24 fresh-air shutter, FIG. 2
25 fresh-air outlet, FIG. 4
26 injector effect in filling space

We claim:

1. A solid fuel combustion device comprising:

a charge-space and a combustion chamber in communication with said charge-space via a combustion outlet, said charge-space being closed in a downward direction by an ash grate, a first channel located between a guide wall and a first side wall of said charge-space and at least one second channel located between a second side wall of said charge-space and a furnace wall, said combustion outlet being at least partially defined by a covering body for preventing incompletely burned gases from entering said combustion chamber, a charge-space cover channel connecting an upper end of said first channel with an upper end of said at least one second channel and at least one fresh air shutter for supplying fresh air to the flow of said incompletely burned gases, said charge-space cover channel sloping downwardly towards said at least one second channel so that the incompletely burned gases formed above said combustion outlet and rising upwardly through said first channel forms a down-draft flow supplied to said at least one second channel and carried downwardly, and said at least one fresh air shutter being provided in said charge-space cover channel so that fresh air is supplied into the down-draft flow and the mixture of air and incompletely burned gas is fed back to the fire bed of the charge-space for combustion.

2. A device according to claim 1, wherein a first fresh-air shutter together with a guide plate is provided in an upper area of said charge-space for restricting supply of fresh air to achieve an injector effect.

3. A device according to claim 2, wherein a second fresh air shutter is provided at the upper end of said at least one second channel and fresh air feed is achieved with an injector effect.

4. A device as defined in claim 1, wherein said covering body is an incandescent body.

5. A device as defined in claim 1, wherein said covering body is a cast or stone block.

6. A device as defined in claim 1, wherein said covering body is formed from at least one solid plate.

7. A device as defined in claim 1, wherein said covering body is arranged on said first wall of said charge-space wall and is inclined downwardly.

8. A device as defined in claim 1, wherein said guide wall is arranged within said charge-space at a selectable distance within and along said first wall of said charge-space beginning above said combustion outlet and extending to a point beneath said charge-space cover channel and forming, together with said first wall of said charge space, said first channel for incompletely burned gases forming in an area of said combustion outlet and flowing upwardly.

9. A device as defined in claim 8, wherein said guide wall is formed as a drop wall that is pivotable about a hinge provided at its lower end.

10. A device as defined in claim 1, wherein a charge-shaft combustion furnace for multi-fuel combustion opens out into said combustion outlet.

11. A solid fuel combustion device comprising:

a charge-space and a combustion chamber in communication with said charge-space via a combustion outlet, said charge-space being closed in a downward direction by an ash grate, a first channel located between a guide wall and a first side wall of said charge-space and at least one second channel located between a second side wall of said charge-space and a furnace wall, said combustion outlet being at least partially defined by a covering body for preventing incompletely burned gases from entering said combustion chamber, a charge-space cover channel connecting an upper end of said first channel with an upper end of said at least one second channel and at least one fresh air shutter for supplying fresh air to the flow of said incompletely burned gases, said charge-space cover channel sloping downwardly towards said at least one second channel so that the incompletely burned gases formed above said combustion outlet and rising upwardly through said first channel forms a down-draft flow supplied to said at least one second channel and carried downwardly, and said at least one fresh air shutter being provided in said at least one second channel so that fresh air is supplied into the down-draft flow and the mixture of air and incompletely burned gas is fed back to the fire bed of the charge-space for combustion.

12. A solid fuel combustion device as claimed in claim 11, wherein a first fresh-air shutter together with a guide plate is provided in an upper area of said charge-space for restricting supply of fresh air to achieve an injector effect.

13. A solid fuel combustion device as claimed in claim 12, wherein a second fresh air shutter is provided at the upper end of said at least one second channel and fresh air feed is achieved with an injector effect.

14. A solid fuel combustion device as claimed in claim 11, wherein said covering body is an incandescent body.

15. A solid fuel combustion device as claimed in claim 11, wherein said covering body is a cast or stone block.

16. A solid fuel combustion device as claimed in claim 11, wherein said covering body is formed from at least one solid plate.

17. A solid fuel combustion device as claimed in claim 11, wherein said covering body is arranged on said first wall of said charge-space wall and is inclined downwardly.

18. A solid fuel combustion device as claimed in claim 11, wherein said guide wall is arranged within said charge-space at a selectable distance within and along said first wall of said charge-space beginning above said combustion outlet and extending to a point beneath said charge-space cover channel and forming, together with said first wall of said charge space, said first channel for incompletely burned gases forming in an area of said combustion outlet and flowing upwardly.

19. A solid fuel combustion device as claimed in claim 18, wherein said guide wall is formed as a drop wall that is pivotable about a hinge provided at its lower end.

20. A solid fuel combustion device as claimed in claim 11, wherein a charge-shaft combustion furnace for multi-fuel combustion opens out into said combustion outlet.

* * * * *